United States Patent [19]

Warren et al.

[11] 4,033,008

[45] July 5, 1977

[54] TOOTHBRUSH

[75] Inventors: William C. Warren, North Brunswick; Anthony R. Volpe, Somerset; Kedar N. Rustogi, Kendall Park, all of N.J.

[73] Assignee: Colgate-Palmolive Company, New York, N.Y.

[22] Filed: Apr. 5, 1976

[21] Appl. No.: 673,769

[52] U.S. Cl. ..... 15/167 R
[51] Int. Cl.[2] ..... A46B 9/04
[58] Field of Search ..... 15/167 R, 167 A, 110, 15/106, 172, 176; 132/84

[56] References Cited

UNITED STATES PATENTS

| | | | |
|---|---|---|---|
| 335,345 | 2/1886 | Estabrook | 15/167 R |
| 1,482,027 | 1/1924 | Ochse | 15/167 R |
| 2,849,740 | 9/1958 | Pauker | 15/167 R X |
| 3,072,944 | 1/1963 | Clayton et al. | 15/167 R |
| Re. 22,938 | 11/1947 | Kisky | 15/167 R |

*Primary Examiner*—Peter Feldman
*Attorney, Agent, or Firm*—Herbert S. Sylvester

[57] ABSTRACT

A toothbrush head has two inner longitudinal rows of relatively soft bristle tufts, two outer longitudinal rows of shorter relatively hard bristle tufts, and a transverse end row of hard bristle tufts that are longer than any of the other tufts, and the end surfaces of the bristle tufts of the inner and outer rows are tapered laterally outwardly from an apex of the softer bristles that extends longitudinally medially of the head.

9 Claims, 5 Drawing Figures

FIG. 1
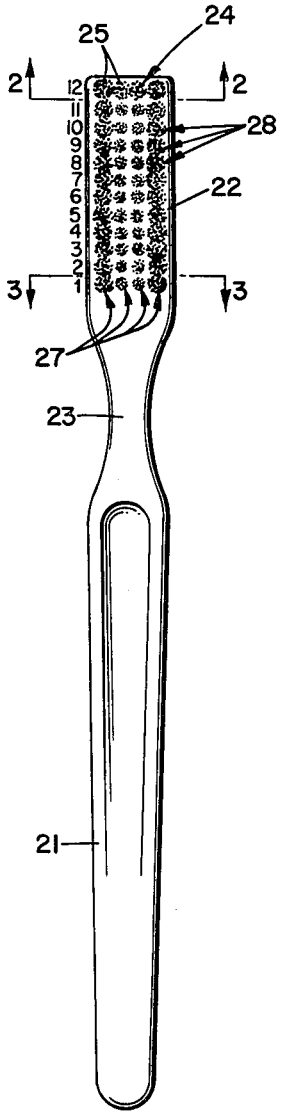
FIG. 2
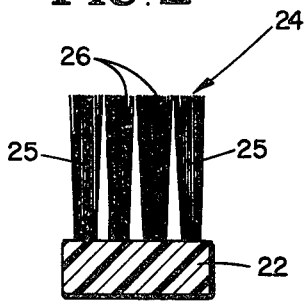
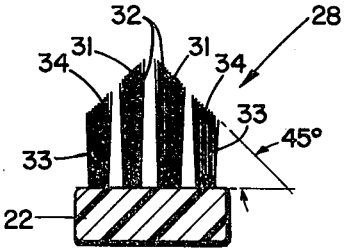
FIG. 3
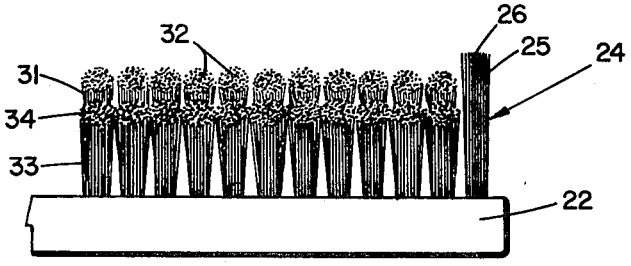
FIG. 4
FIG. 5
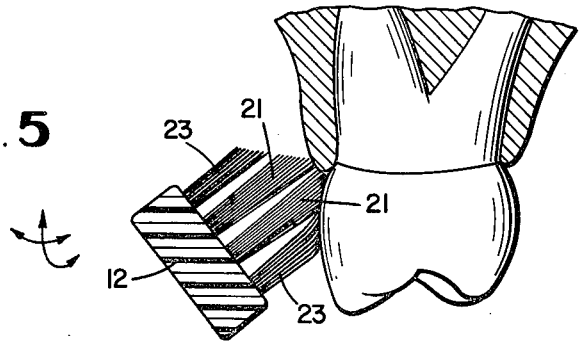

TOOTHBRUSH

This invention relates to toothbrushes and is particularly concerned with a dual action toothbrush incorporating relatively hard and soft bristles and a special bristle arrangement for optimum cleaning.

Since it is well known that one of the primary causes of tooth decay and associated problems is the accumulation of dental plaque on tooth surfaces and accretions and deposits, usually soft food and the like, between the teeth and in recessed or grooved regions on the teeth, or between the teeth and the adjacent gingival areas, the practice of regularly and frequently brushing teeth to remove plaque and other material is recommended and has become daily practice.

As a consequence, many different designs of toothbrushes have been proposed and since there are almost as many different theories as to proper tooth brushing, these toothbrushes vary widely in design and bristle shape and arrangement. Most conventional toothbrushes are sold with either hard, medium or soft bristles to adapt relative bristle hardness to the sensitivity or requirements of a particular user.

It has also been proposed to provide a toothbrush wherein a row of softer bristles is flanked on opposite sides by rows of longer harder bristles, as disclosed in Olson U.S. Pat. No. 2,797,424 issued July 2, 1957. Also it has been proposed to provide outwardly tapered bristle tufts as disclosed in Coney et al U.S. Pat. No. 2,088,839 issued Aug. 3, 1937, and to provide a toothbrush having an end row of longer bristles as disclosed in Rose U.S. Pat. No. 669,402 issued Mar. 5, 1901. Bowman U.S. Pat. No. 461,661 issued Oct. 20, 1891 discloses rows of tapered bristles tufts with a longer transverse end row. The invention provides a novel hard and soft bristle arrangment and tuft location and shape that mutually contribute to improved safe tooth cleansing.

More specifically the present invention is directed to a novel toothbrush wherein respective outer and inner row groups of bristle tufts of at least two different bristle hardnesses, preferably hard and soft respectively, are shaped and arranged in special relationship for simultaneously acting on tooth and adjacent gingival areas requiring different cleansing techniques. Preferably also one sub-group of longer harder bristles is disposed for selective use in contacting difficult to reach tooth surfaces such as those in the lingual regions of the anterior teeth, and between the teeth.

Bristle stiffness is inversely proportional to length and directly proportional to the width or diameter of the bristle. In the invention groups of relative hardness are attained by providing at least one "harder" outer group consisting of tufts of bristles that are shorter in length and of relatively larger diameter, and a "softer" inner group consisting of tufts that are of greater length and smaller diameter as compared to the "harder" group. In the preferred form of the invention as will appear this hard and soft grouping is associated with a special laterally tapered bristle end arrangement.

It is therefore an advantageous feature of the invention to provide a novel toothbrush having distinct and cooperatively located groups of harder and softer bristles.

A further advantageous feature is that the group of harder bristles, preferably tufts of shorter larger diameter bristles, is located laterally outwardly of a group of inner more soft bristles, preferably tufts that are of longer and smaller diameter bristles.

Another advantageous feature is a novel toothbrush wherein inner longitudinal rows of softer bristles define an inner longitudinally extending apex and the bristle ends lie in zones that are tapered laterally toward outer rows of harder bristles.

Further advantageous features will appear as the description proceeds in connection with the appended claims and the annexed drawings.

BRIEF DESCRIPTION OF DRAWINGS

FIG. 1 is a plan view showing a toothbrush according to a preferred embodiment;

FIG. 2 is a section substantially on line 2—2 of FIG. 1 showing the longer transverse end row of bristles;

FIG. 3 is a section substantially on line 3—3 of FIG. 1 showing the shape of each remaining transverse end row;

FIG. 4 is a side elevation of the head end of the toothbrush of FIG. 1; and

FIG. 5 is a relatively diagrammatic view showing the brush in a particularly advantageous cleansing position relative to the teeth and adjacent gingival surfaces.

PREFERRED EMBODIMENTS

The toothbrush of the invention comprises the usual semi-rigid handle 21 connected to the generally rectangular head 22 by a reduced width section 23. The handle, neck and head preferably are conventionally integral parts of a bar or beam of relatively stiff plastic of substantially constant thickness. The head surface at the bristle side is preferably flat as shown.

As shown the bristles are arranged in an orderly manner on the head, there being a series of tufts of bristles aligned in longitudinal rows and a series of tufts of bristles aligned in much shorter transverse rows. For identification in FIG. 1 the transverse rows are marked 1–12.

The far end transverse row 24 of bristle tufts most remote from the handle consists of a spaced plurality of bristle tufts 25 that are longer than any of the other tufts (FIGS. 2 and 4). In a preferred embodiment four bristle tufts 25 with equally spacing between adjacent tufts are provided in row 24. The ends of the bristles in row 24 are preferably cut flat so that they all lie in a substantially common plane extending at right angles to the length of the tufts and parallel to the flat head. These end surfaces of tufts 25 are indicated at 26 in FIG. 4.

A multiplicity of longitudinal parallel rows 27 of bristle tufts may be provided on the head. Each longitudinal row is aligned with one of the bristle tufts 25 of the far end row 24, so that there are as many parallel longitudinal rows 27 as there are tufts in the far end row. Each longitudinal row has the same number of tufts of bristles.

The adjacent bristle tufts in all of the longitudinal rows are equally spaced, so that in effect they form a series of longitudinal spaced transverse rows parallel to each other, and the adjacent tufts in each transverse row are equally spaced. Thus preferably each pair of adjacent tufts in the assembly is equally spaced. The transverse rows other than end row 24 are indicated as rows 28 and comprise the eleven transverse rows nearest the handle.

Four bristle tufts are preferred in each transverse row. The relative shapes of the bristle tufts in each transverse row 28 is shown in FIG. 3. All of these other bristle tufts are shorter than bristle tufts 25 (FIG. 4) and the outer ends of the tufts of these transverse rows 1–11 are tapered laterally outwardly with respect to the longitudinal center of the head, so that as shown in FIG. 3 the two adjacent inner tufts 32 of each transverse row 28 are of the same length but have equally oppositely inclined end surfaces 31, and the outer tufts 33 of each transverse row 28 are shorter than the inner tufts 32 and have oppositely inclined end surfaces 34. The surfaces 31, 34 at each side lie in planes that are parallel to the length axis of head 22, and these planes intersect in an apex midway between the sides of head 22. The angle of the planes containing surfaces 31, 34 at each side relative to the plane of the head is preferably about 45°. Thus the tufts of the two inner longitudinal rows 27 are longer than the tufts of the outer longitudinal rows 27.

It is an important feature of the invention that the outer bristle tufts of far end row 24 and the two outer longitudinal rows 27 are harder than the remaining inner tufts of bristles.

A preferred way of achieving this relative hardness is that the outer bristle tufts including end row 24 may consist of nylon or like bristles about 0.009 inch in diameter, while the inner bristle tufts may consist of nylon or like bristles about 0.007 inch in diameter.

All bristles are secured in the head in a conventional manner, and all bristle ends are rounded and polished as in conventional practice.

In a preferred form of the invention the combined handle and head is about 6½ inches long, and the head is about 1½ inches long by ½ inch wide. The bristle tufts consist of nylon bristle elements anchored at one end in the head and the tufts are arranged in twelve longitudinally spaced parallel transverse rows of four tufts each. Alternately they may be said to be arranged in four parallel longitudinal rows of twelve tufts each. All rows are linear, and the adjacent tufts throughout are substantially equally spaced.

The transverse end row 24 most remote from the handle contains bristles each about 7/16 inch in length and 0.009 inch in diameter. The ends of these tufts are cut squarely and flat to lie in a transverse plane parallel to the head.

All of the other transverse rows 28 are preferably of shorter tuft length than those in row 24, and each other transverse row 28 is essentially the same. The bristles of the two inner longitudinal rows 27 are longer and of smaller diameter than those of the two outer longitudinal rows.

The maximum length of the bristles of the inner longitudinal rows 27, at the longitudinal medial center of the head where these inner longitudinal rows define the apex of the laterally tapered brush section is about ⅝ inch, and the surfaces 31, 34 incline laterally outwardly and downwardly at about 45° toward the head from that apex. Thus the 11 tufts of each outer longitudinal row 33, which consist of shorter and greater diameter bristles than the inner longitudinal rows 31, are appreciably stiffer and harder.

The remote transverse end row 24 has longer bristles but is composed of larger diameter bristles, so that in this row the tufts are harder than in the inner longitudinal rows 27.

In the foregoing construction the harder outer and transverse end rows of bristles effectively extend around and confine an area of mainly longer softer bristles that may collapse under pressure to define combination hard and soft bristle surfaces adapting the brush to complex surfaces.

In use of the toothbrush of the invention the softer inner bristles of rows 31 may be initially in intimate continual contact with both the gingiva and adjacent tooth surfaces, as shown in FIG. 5. The brush head is oscillated while exerting gentle pressure to produce a slight vibratory motion. This is highly advantageous in that during movement of the brush head the softer inner bristles dislodge deposits on these "para-gingival" areas of the teeth while at the same time mechanically gently scrubbing the gingival sulcus and the juncture between the tooth and gum. The bristles softness in this critical zone aids in minimizing injury to the soft gingival tissue. At the same time one outer row 33 of harder bristles is not in contact with adjacent tooth surfaces only, and during head movement this removes plaque from those surfaces.

Then as the head is rocked clockwise in FIG. 5 and moved down to brush only tooth surfaces the softer inner bristles will be collapsed and effectively confined within an outer border of harder bristles thereby adapting the brush to cleanse the natural complex grooves, planes and changing contour tooth surfaces where food bits and bacteria may accumulate.

Besides serving to reach difficult areas of the mouth, as to brush the lingual surfaces of the anterior teeth and the distal-most surfaces of the posterior teeth, the longer remote end row 24 of harder bristles is effective during the operation illustrated in FIG. 5, to reach the approximal surfaces of the teeth when advanced along the various tooth brushing segments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A toothbrush comprising a handle terminating at one end in a head and at least two distinct groups of bristle tufts projecting from the head, one of said groups comprising a plurality of rows of relatively soft bristle tufts extending longitudinally of the head and the other of said groups comprising rows of relatively hard bristle tufts extending longitudinally of the head alongside and laterally outwardly and on opposite sides of said one group, the tufts of said one group being longer and of smaller diameter bristles than the tufts of said other group, and a transverse row of bristle tufts on the end of the head remote from the handle and comprising bristle tufts that are longer than any of the other bristle tufts on the head the bristle tufts of said end row being harder and of larger diameter than the bristle tufts of said one group.

2. The toothbrush defined in claim 1, wherein the inner group consists of two longitudinal rows of bristle tufts, and the outer group consists of longitudinal rows of bristle tufts extending along opposite sides of the inner group.

3. The toothbrush defined in claim 2, wherein said rows are parallel and of the same number of equally spaced tufts.

4. The toothbrush defined in claim 1, wherein the free ends of a bristle in said remote end row lie in a plane above the other bristle end surfaces and substantially parallel to the head.

5. The toothbrush defined in claim 1, wherein the bristles of the inner group are fibers of nylon or the like about 0.007 inches in diameter, and the bristles of the outer group are fibers of nylon or the like about 0.009 inches in diameter.

6. The toothbrush defined in claim 1, wherein the free end surfaces of said groups lie in oppositely inclined intersecting planes defining an apex of softer bristles extending substantially medially longitudinally of the head.

7. The toothbrush defined in claim 1, wherein the free end surfaces of the bristle tufts of said groups are each tapered at an angle of about 45°.

8. A toothbrush comprising a relatively flat head, two longitudinal side by side inner rows of bristles tufts projecting from said head, two outer longitudinal rows of bristle tufts projecting from said head at opposite sides of said inner rows, the tufts of said inner rows being longer than those of the outer rows, a transverse end row of bristle tufts bridging two adjacent ends of said outer rows and comprising tufts that are longer than any of the other tufts on the head, the bristles of said outer rows and the transverse end rows being harder than those of the inner rows whereby said outer and end rows effectively confine an area of softer bristles, and the free surfaces of all the tufts of said inner and outer rows being tapered laterally outwardly and toward the plane of the head to define a longitudinally extending apex of longer softer bristles.

9. The toothbrush defined in claim 1, wherein the bristles in said transverse end row are of about the same diameter as the bristles in the outer of said groups.

* * * * *